US005927540A

United States Patent [19]

Godlewski

[11] Patent Number: 5,927,540

[45] Date of Patent: Jul. 27, 1999

[54] CONTROLLED DISPENSING SYSTEM AND METHOD

[75] Inventor: Peter P. Godlewski, San Carlos, Calif.

[73] Assignee: Omnicell Technologies, Inc., Palo Alto, Calif.

[21] Appl. No.: 08/915,470

[22] Filed: Aug. 20, 1997

[51] Int. Cl.[6] ..... G07F 11/00

[52] U.S. Cl. ..... 221/2; 221/103; 312/209

[58] Field of Search ..... 221/2, 9, 7, 15, 221/92, 103, 154, 247, 256, 249; 312/209, 291

[56] References Cited

U.S. PATENT DOCUMENTS

| | | | |
|---|---|---|---|
| 4,019,793 | 4/1977 | Gerding | 312/209 |
| 4,114,965 | 9/1978 | Oye et al. | 312/209 |
| 4,127,311 | 11/1978 | Weiman | 312/209 |
| 4,267,942 | 5/1981 | Wick, Jr. et al. | 221/2 |
| 4,518,208 | 5/1985 | Marder | 312/209 |
| 4,588,237 | 5/1986 | Marder | 312/209 |
| 4,813,753 | 3/1989 | Relyea | 312/291 |
| 4,847,764 | 7/1989 | Halvorson | 364/413.02 |
| 4,967,928 | 11/1990 | Carter | 221/2 |
| 5,014,875 | 5/1991 | McLaughlin et al. | 221/2 |
| 5,047,948 | 9/1991 | Turner | 364/479 |
| 5,139,321 | 8/1992 | Beardsley | 312/209 |
| 5,159,581 | 10/1992 | Agans | 368/10 |
| 5,392,951 | 2/1995 | Gardner et al. | 221/2 |
| 5,437,290 | 8/1995 | Bolger et al. | 128/898 |
| 5,460,294 | 10/1995 | Williams | 221/2 |

FOREIGN PATENT DOCUMENTS 352 643 1/1990 Germany .

*Primary Examiner*—Kenneth Noland
*Attorney, Agent, or Firm*—Townsend and Townsend and Crew LLP

[57] ABSTRACT

The present invention provides apparatus and methods for dispensing articles. In one exemplary embodiment, an apparatus comprises a cabinet defining an enclosure and at least one drawer is attached to the cabinet. The drawer slides in and out of the cabinet and contains an array of compartments. At least one lid is provided and is configured to slide back and forth with respect to the drawer. Each drawer further includes a distance sensor for detecting the distance traveled by the lid relative to the drawer. A controller is placed in communication with both the locking mechanism and the distance sensor. The controller sends a signal to actuate the locking mechanism after the lid has been moved to expose a desired compartment. In this manner, the lid can be moved to allow access to a compartment containing a desired article or medical supply. The locking mechanism prevents further movement of the lid, thereby preventing access to any additional compartments.

23 Claims, 13 Drawing Sheets

CONTROLLED DISPENSING SYSTEM AND METHOD

BACKGROUND OF THE INVENTION

The present invention relates generally to the field of dispensing systems. More particularly, the present invention relates to the construction and use of dispensing systems which provide controlled access to medical inventories stored therein.

In large medical facilities, inventories of medical supplies are normally held in centralized storage locations or pharmacies which are often far removed from the patients. To facilitate delivery of pharmaceuticals to the patients, a variety of dispensing systems have been proposed which are maintained in remote areas of the medical facility, closer to the patients. For example, several dispensing systems have been proposed which employ a cart or cabinet which is located in a patient wing or treatment area of the facility. These dispensing systems contain medical supplies and pharmaceuticals typically used in that part of the facility.

Of particular interest to the present invention are remote dispensing stations which dispense pharmaceuticals and other items which require close monitoring and control. A variety of schemes have been proposed for providing secured access to pharmaceuticals that are held within such dispensing stations, including locking the pharmaceuticals within carts or by allowing access to only one item at a time, commonly referred to as "single dose dispensing."

One such system is described in U.S. Pat. No. 5,014,875 titled "Medication Dispenser Station." This system comprises a multiple-drawer cabinet for holding pharmaceuticals, with each drawer containing a covered, multiple-compartment carousel. Access to each drawer and each carousel compartment is controlled to allow access to the contents after a predetermined code or other information has been entered into a controller. Another similar system is described in U.S. Pat. No. 4,847,764 titled "System for Dispensing Drugs in Health Care Institutions." This dispensing system involves a computer system connected to a number of remote medication dispensers. The computer system includes software for, among other things, controlling access to the medications, identifying potentially dangerous drug interactions, and assisting with inventory control. The remote medication dispensers comprise a number of cabinets, with each cabinet holding a number of unit dose medication packages.

Although such systems have found some acceptance in the industry, many of these systems fail to recognize several important issues which should be addressed in today's competitive health care industry. For example, the dispensing system (while still providing adequate security) should be able to provide convenient access to large inventories of items. In addition, the dispensing system should make efficient use of the cabinet space. Further, the dispensing system should be able to maintain an accurate accounting of the items removed. In this way, a caregiver may be afforded easy access to the items and be assured that adequate levels of a wide variety of pharmaceuticals will be available. At the same time, the health care facility will be able to carefully control how its drugs are dispensed. It also would be desirable if such a system allowed for pharmaceuticals to be dispensed in single doses or in single item quantities. In one particular aspect, it would be desirable if the dispensing system were to allow access to only specific numbers and types of items selected by the caregiver. In another aspect, it would be desirable if such a dispensing system were able to control access based at least in part on user identification and/or patient identification which is entered by the caregiver.

SUMMARY OF THE INVENTION

The present invention provides apparatus and methods for dispensing articles in a carefully controlled manner. In one exemplary embodiment, the invention provides an apparatus comprising a cabinet defining an enclosure. At least one drawer is attached to the cabinet and is configured to slide in and out of the cabinet. The drawer contains an array of compartments. At least one lid is attached to the drawer and is configured to slide forward and backward with respect to the drawer. Each drawer further includes a locking mechanism which may engage the lid at selective locations along the lid. With this arrangement, the locking mechanism may engage the lid to prevent movement of the lid relative to the drawer after a certain compartment has been exposed. Each drawer further includes a distance sensor for detecting the distance traveled by the lid relative to the drawer. A controller is placed in communication with both the locking mechanism and the distance sensor. The controller sends a signal to actuate the locking mechanism after the lid has been moved to expose a desired compartment. In this manner, the lid may be moved to allow access to a compartment containing a desired article or medical supply. The locking mechanism then engages the lid to prevent further movement of the lid, thereby preventing access to additional compartments.

Optionally, the drawer also may contain a lock to lock the drawer to the cabinet. In this fashion, both the drawer and the drawer lid must be unlocked to access desired articles within the drawer compartment.

In one exemplary aspect, the lid includes a plurality of distance indicators which are each spaced apart by a known distance. With this configuration, the distance sensor comprises a counter which counts the number of distance indicators which pass within its field of vision. The distance sensor further comprises a direction sensor which detects the direction of movement of the lid relative to the drawer. In this manner, the distance sensor detects both the direction and distance the lid has moved. In one aspect, the distance indicators comprise an arranged patterns of notches. In another aspect, the counter comprises an IR pair, through which the notches of the lid are passed.

In still another aspect, the lid comprises a first side, a second side and a top. The first and second sides include notches, with the notches on one of the sides offset from the notches on the other side. With this arrangement, the direction counter comprises two IR pairs which are aligned with each other. To detect the direction of lid movement, the notches of the first side are arranged to pass through the first IR pair and the notches of the second side are arranged to pass through the second IR pair, with the controller tracking the direction of lid movement.

In a further aspect, the lid includes a plurality of slots, and the locking mechanism comprises at least one solenoid having an arm which engages the slots to lock the lid in place. In this manner, when the lid has been slid back to reveal a selected compartment, the locking mechanism activates to lock the lid in place. In still another aspect, the first and second sides of the lid include offset slots and the locking mechanism comprises a pair of solenoids, with one solenoid being associated with each of the lid sides. This arrangement allows for an increased number of locking positions for the lid.

In another aspect, the array of compartments is formed within a tray which is removable from the drawer. In an additional aspect, the drawer includes multiple trays, each of which includes an array of compartments. The trays include interlocks for connecting the trays within the drawer. In this fashion, a large variety of medical supplies can be stored in the cabinet.

In a further aspect, the controller includes an entry device for entering article removal information. In this manner, the lid is locked by the locking mechanism until removal information is entered into the controller.

In an additional aspect, the cabinet further comprises multiple columns of compartments. A visual indicator is included on the drawer adjacent to each of the columns. The visual indicators are in communication with the controller so that the visual indicator which is adjacent the column having a requested article may be actuated. This visual indicator assists the care giver in locating the correct drawer containing the desired articles.

The invention further provides an exemplary method for dispensing articles from a cabinet having at least one drawer, with the drawer having an array of compartments for holding the articles. The cabinet further includes at least one lid which is slidably attached to the drawer to prevent access to the compartments when positioned over the compartments. The lid slides relative to the drawer to sequentially expose the compartments. According to the method, the drawer is withdrawn from the cabinet to expose the lid and the lid is then slid from the drawer to sequentially expose the array of compartments. The lid is withdrawn until a first one of the compartments having an article is exposed. At this point, movement of the lid relative to the drawer is prevented in a direction which would expose any additional articles. The article is then removed from the compartment.

In one aspect of the method, the cabinet includes a controller which allows article removal information to be entered into the controller before the lid will be unlocked. Such a method allows both the caregiver and the health care facility to keep track of which articles have been removed.

In another aspect, the user enters the number of articles to be removed into the controller. The sliding lid can then be moved to expose the selected number of articles. Movement of the lid relative to the drawer in a direction which would expose any additional articles is prevented.

In another aspect of the method, movement of the lid relative to the drawer is prevented with a locking mechanism which engages the lid. In a still further aspect, the method comprises storing information regarding which compartments in the array have an article therein, and further comprising determining the distance travelled by the lid relative to the compartments. After the lid has been moved a distance sufficient to expose only the first one of the compartments having the article, the locking mechanism is actuated. In this manner, the lid allows access to only the selected article and then locks the lid to prevent additional articles from being exposed.

In still another aspect, the lid includes a plurality of distance indicators. With this arrangement, the step of determining the distance travelled by the lid comprises counting the number of distance indicators on the lid and determining the direction of travel of the lid relative to the drawer.

In a further aspect, the lid comprises a first side, a second side, and a top. The first and second sides include alternating notches and the cabinet includes a pair of aligned sensors. The step of determining the direction of travel comprises sensing the order of alternation of the notches on the first and the second sides with the sensors when the lid is moved.

In another aspect, the locking mechanism comprises a solenoid having an arm and the lid includes a plurality of slots. In this manner, the lid is locked to the drawer by engaging the arm with one of the slots.

In still another aspect, the drawer is locked to the cabinet and the user enters user and/or patient identification information into the controller to unlock the drawer from the cabinet. In this manner, a user must unlock both the drawer and the lid prior to having access to the desired articles.

In a further aspect of the method, only a single article is held within each compartment. In this manner, single dose dispensing is obtained by providing access to only a single compartment at a time.

In another aspect of the method, the drawer includes multiple arrays of compartments which are arranged in columns. Upon selection of an article, a visual signal is produced adjacent the column having the selected article. This signal assists the user in locating the drawer containing the selected article.

DETAILED DESCRIPTION OF THE SPECIFIC EMBODIMENT

The invention provides an exemplary dispensing apparatus and methods which provide controlled access to secured articles. The articles are stored within a portable cabinet having a controller which may be configured to operate in a manner similar to the controllers described in co-pending U.S. application Ser. Nos. 08/274,926, filed Jul. 14, 1994 and 08/544,379, filed Oct. 10, 1995, the disclosures of which are herein incorporated by reference. The controller will preferably include, among other information, a list of patients and the types and quantities of articles held within the cabinet. The dispensing apparatus preferably includes a plurality of pull-out drawers which are configured to store large quantities of medical supplies and/or pharmaceuticals.

The invention provides for controlled access to the articles within the drawers by requiring certain information, e.g., user identification, patient identification, and/or article identification information, to be entered into the controller before access to the supplies will be afforded. In particular, access to specific compartments within each drawer is controlled so that only certain articles which have been preselected are made available for removal. Although useful in storing most medical supplies and pharmaceuticals, dispensing systems of the present invention will find their greatest use in storing pharmaceuticals that require high levels of security and whose availability in single dose quantities is desired.

Figure 1:
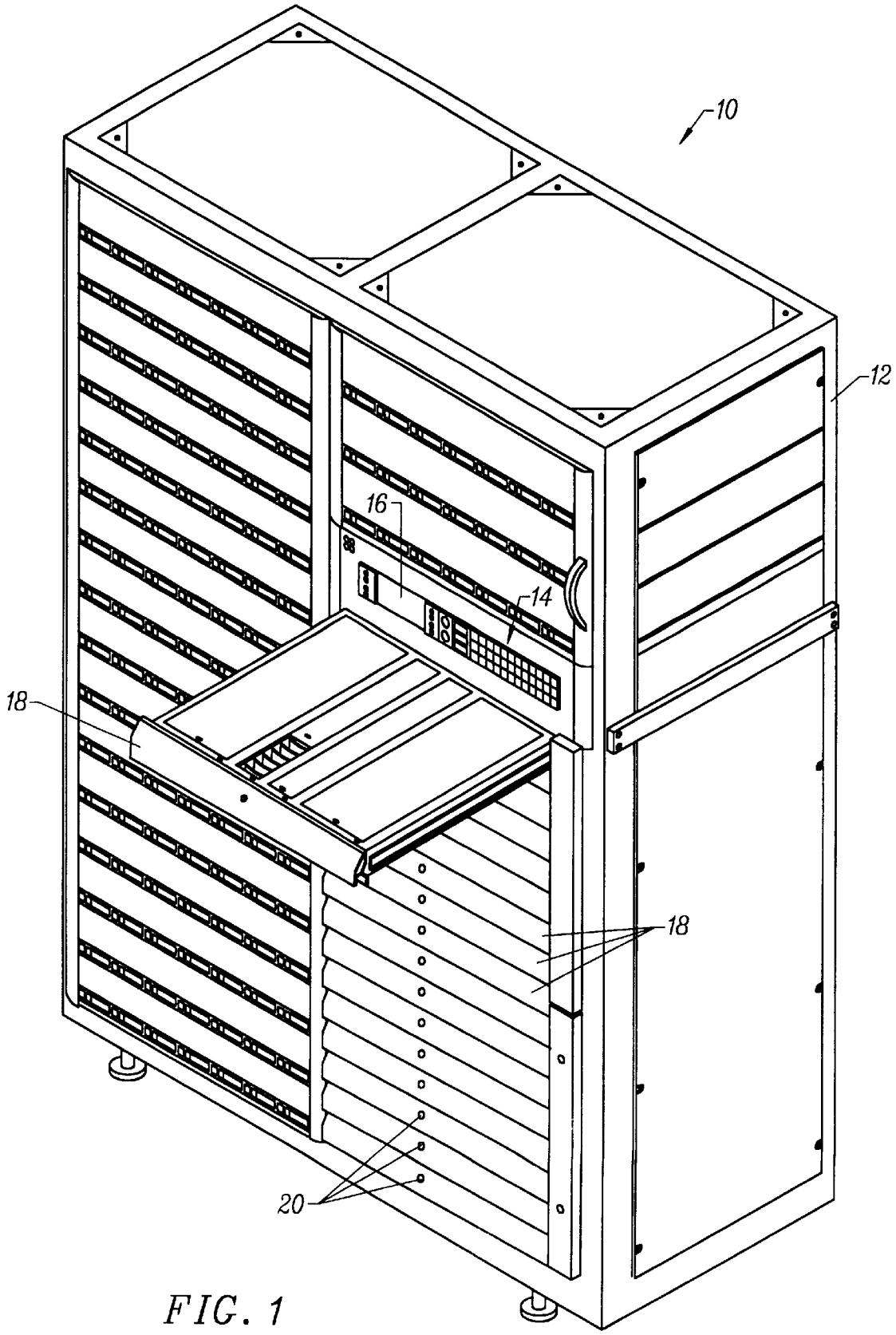
FIG. 1 is a perspective view of an exemplary dispensing apparatus having a plurality of drawers according to the invention.

Referring now to FIG. 1, an exemplary embodiment of an apparatus 10 for dispensing articles will be described. Apparatus 10 comprises a cabinet 12 having a controller (hidden behind cabinet 12), a controller keypad 14, and a user viewscreen 16. The controller controls access to the articles within apparatus 10 by requiring the caregiver to input information identifying the user and/or the patient and the article to be retrieved from apparatus 10 before access will be afforded. Additionally, the controller may be connected to a local area network or other health care facility computer system so that the data stored within the controller may be frequently updated.

Cabinet 12 contains a plurality of drawers 18 and visual indicators 20 which are associated with each drawer 18. The particular size of cabinet 12 and number of drawers 18 will vary depending upon the particular application. As shown in FIG. 1, drawers 18 of cabinet 12 are preferably arranged in columns to provide storage for a wide variety of medical supplies and/or pharmaceuticals.

Figure 2:
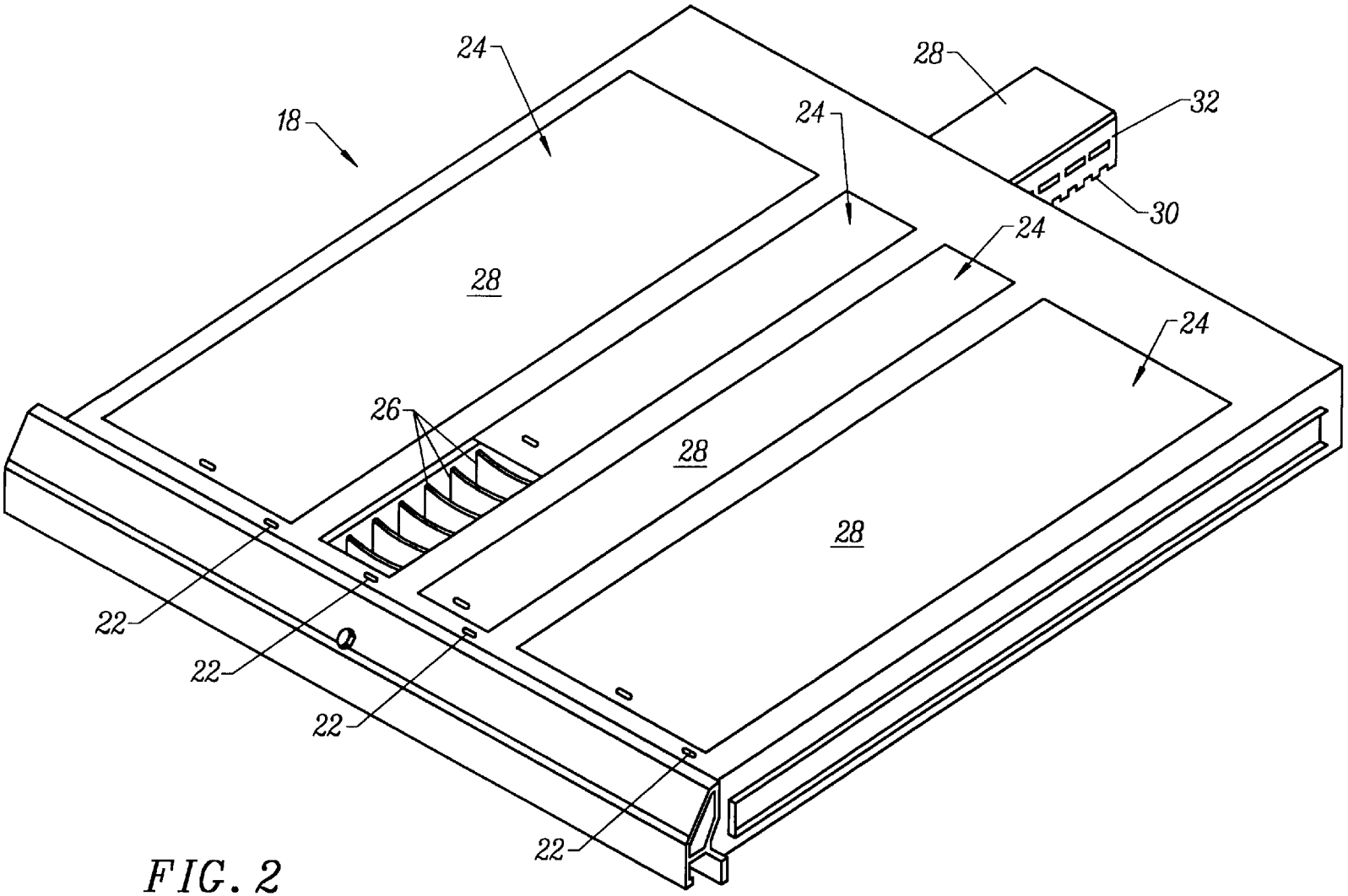
FIG. 2 is a detailed view of a drawer of the dispensing apparatus of FIG. 1.

Referring to FIG. 2, an individual drawer of apparatus 10 will be described. Drawer 18 comprises a plurality of trays 24. Each tray 24 has a tray indicator 22 which may illuminate or otherwise indicate which tray 24 in drawer 18 contains an article that was selected at keypad 14. Each tray 24 further includes a plurality of compartments 26 for storing articles, such as medical supplies or pharmaceuticals. Drawer 18 also contains a plurality of tray lids 28, which are arranged such that each tray 24 is covered by a single lid 28. As shown in FIG. 2, lid 28 contains a plurality of notches 30 and slots 32. As described below, notches 30 and slots 32 are used to lock lid 28 in place with respect to drawer 18 and to determine the position of lid 28 relative to tray compartments 26.

Figure 3:
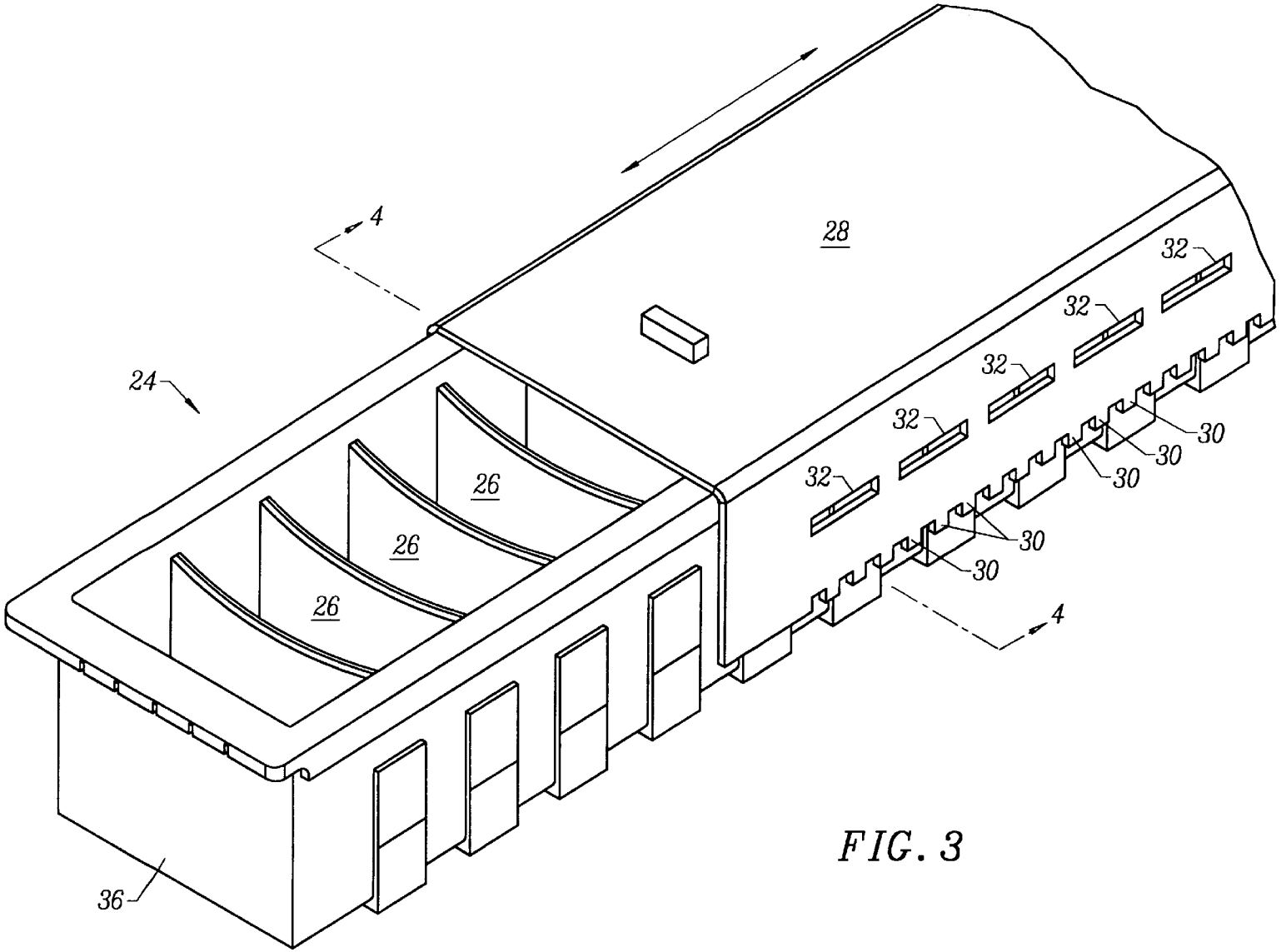
FIG. 3 is a detailed view of a tray and lid taken along line 4—4 of the dispensing apparatus of FIG. 1.
Figure 4:
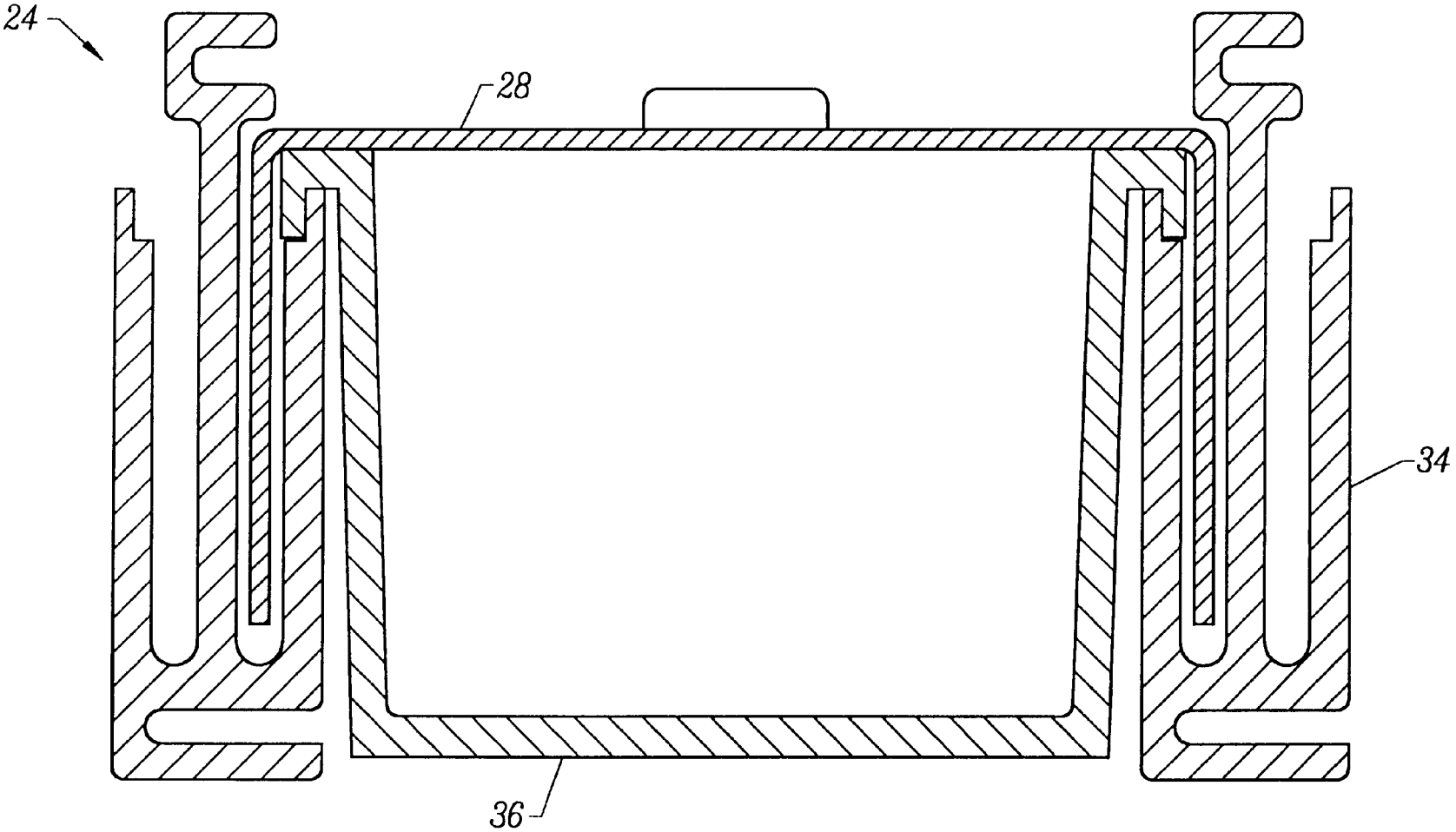
FIG. 4 is a cross-sectional view of the tray and lid of FIG. 3.

Referring to FIGS. 3 and 4, one tray 24 of drawer 18 will be described. As shown in FIG. 3, a lid 28 is configured to slide over tray 24 to sequentially cover or expose the interior of compartments 26. An interlock 34 which is securely attached to drawer 18 maintains tray 24 within drawer 18 so that it cannot be removed unless the user has entered the appropriate information at keypad 14 required to permit tray 24 removal. As best shown in FIG. 4, interlock 34 extends partially over lid 28 to prevent a user from lifting lid 28 off tray 24. In this way, interlock 34 permits lid 28 to be slid back and forth while preventing lid 28 from being removed. Still referring to FIG. 4, a tray bottom 36 fits within interlock 34. Lid 28 covers tray bottom 36 and slides back and forth over tray bottom 36 and under the upper lip of interlock 34.

Figure 5:
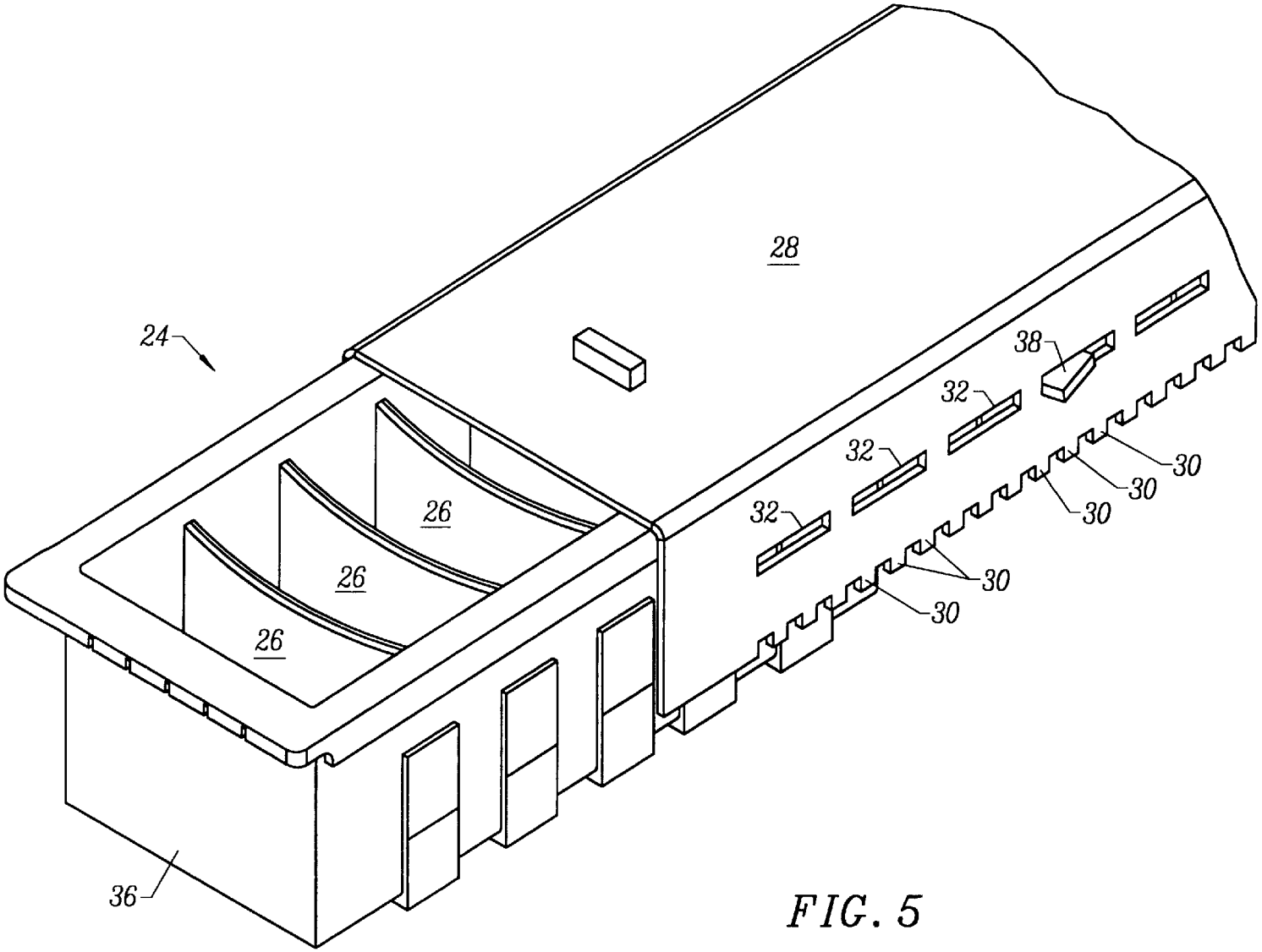
FIG. 5 is a detailed view of the tray and lid of FIG. 3, showing an arm engaging a lid slot to lock the lid to the tray.
Figure 6:
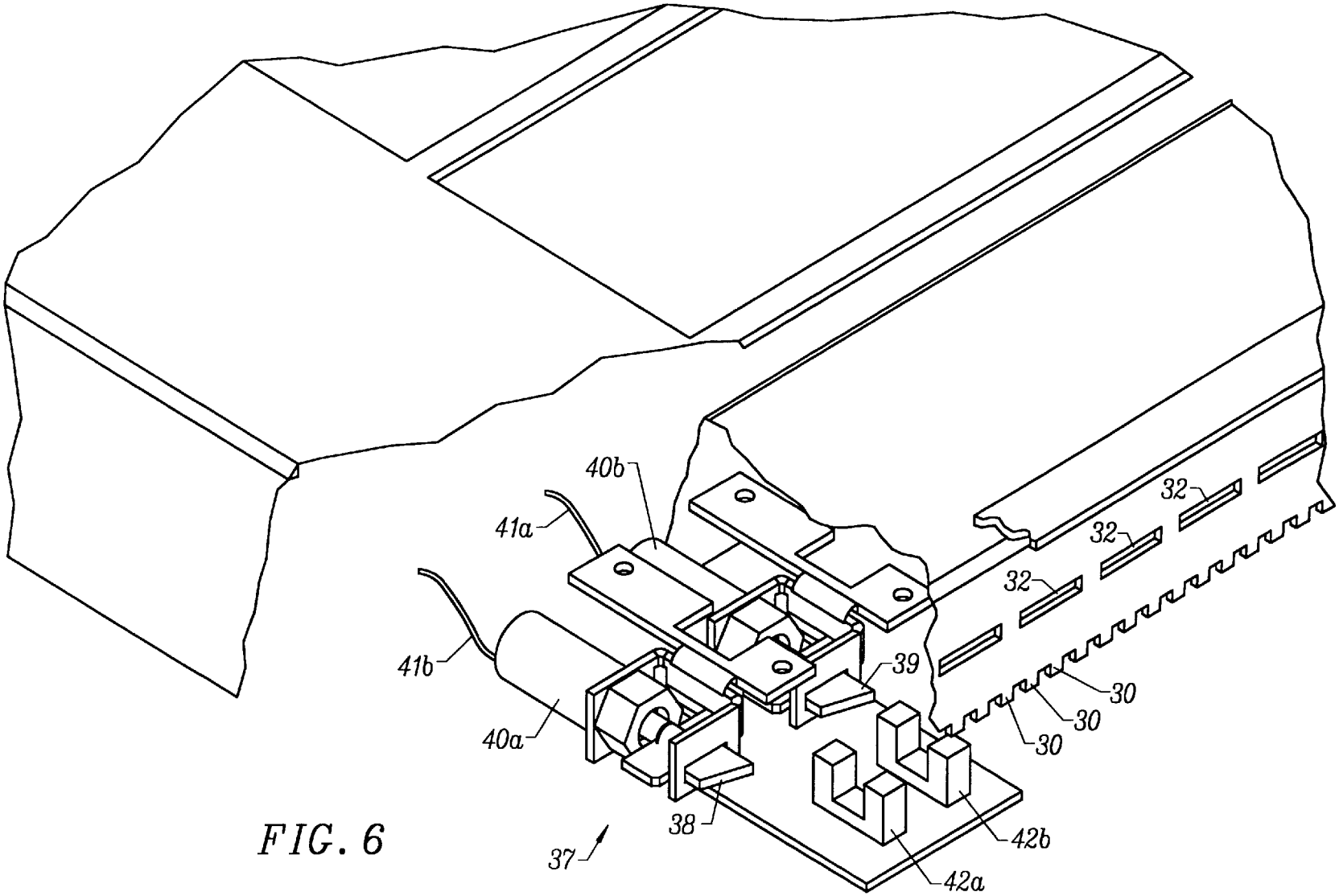
FIG. 6 is a cut away view of the tray of FIG. 5 showing a locking mechanism which is employed to lock the lid to the tray.

Referring now to FIGS. 5 and 6, operation of a locking mechanism 37 to selectively control access to compartments 26 will be described. As shown in FIG. 5, locking mechanism 37 includes an arm 38 which is translated into one of slots 32 to lock lid 28 in place with respect to tray compartments 26. As shown in FIG. 6, locking mechanism 37 further comprises a pair of solenoids 40 which are connected to the controller by solenoid wires 41. Solenoids 40 translate arms 38 to engage slots 32. Once arm 38 is within slot 32, lid 28 cannot be moved relative to compartments 26, thereby preventing access to any compartments which remain covered. Slots 32 are coordinated with compartments 26, such that when an arm 38 engages one of the slots 32, its associated compartment 26 is exposed. If arm 38 engages the next sequential slot 32, the next sequential compartment 26 is exposed.

Two IR pairs 42 are employed to determine the distance lid 28 has moved relative to compartments 26. This is accomplished by counting the total number of notches 30 which pass through each IR pair 42 and by tracking the direction of travel of lid 28 relative to compartments 26. In this manner, if a user slides lid 28 back and forth, its position relative to compartments 26 will be known at all times. Tracking the direction of lid 28 movement is accomplished by sensing notches 32 on the bottom of the sides of lid 28 which pass through the IR pair 42 field of view. Since IR pairs 42 are aligned with each other and notches 32 are offset by ½ notch length, the controller can determine which direction lid 28 has moved. Alternatively, the direction of movement of lid 28 can be determined by using offset IR pairs 42 and aligned notches 32. Hence, by knowing both distance and direction of lid 28 movement, the controller can determine the location of lid 28 relative to compartments 26 and can send a signal to solenoid 40 to lock lid 28 at the appropriate position.

As shown in FIG. 6, locking mechanism 37 comprises two solenoids 40. A two-solenoid locking mechanism 37 may be used a number of different ways within the scope of the invention. For example, both solenoids 40 may be disengaged until the controller determines that lid 28 has been moved to expose the desired compartment 26. At this point, the controller signals either one or both solenoids 40 to translate arms 38 to engage the slots 32 corresponding to the desired compartment 26, thereby locking lid 28 in place while exposing the desired compartment 26. Optionally, friction pads may be employed to increase the friction between the lid 28 and tray 24 to help control the speed of lid 28 withdrawal. In this manner, the controller is provided with sufficient time to engage solenoids 40 before the lid 28 has been withdrawn past the desired compartment 26.

Alternatively, the controller may be configured so that every slot 32 along the path to the desired compartment 26 is engaged for some time. In this way, as lid 28 slides back or forward to expose or cover compartments 26, lid 28 would lock into place at each slot 32. After each slot 32 is engaged, the controller determines if the desired compartment 26 has been exposed. If the desired compartment 26 remains covered, the controller signals the engaged solenoids 40 to disengage, thereby unlocking lid 28. As the lid 28 is slid back, the second arm 38 (which is spring biased against the lid) clicks into place in the next sequential slot 32, thereby exposing the next sequential compartment 26. This procedure continues until the desired compartment 26 has been exposed. Once the desired compartment 26 has been exposed, lid 28 remains locked in place and further lid movement is denied. In this manner, the controller prevents the drawer 18 from being pulled open past the desired compartment 26, thereby ensuring that only a single compartment 26 containing the desired article is exposed.

While two solenoids 40 are shown in FIG. 6, it will be appreciated that a single or multiple solenoids could also be used to lock lid 28 in place. At least two IR pairs 42 are required for quadrature in order to permit the controller to determine the direction lid 28 has moved relative to tray compartments 26.

Referring now to FIGS. 1 through 6, an exemplary method for dispensing articles from apparatus 10 will be described. First, the user inputs user and/or patient identification information into the controller. Optionally, certain drawers 18 may be locked to allow access to these drawers 18 based on only appropriate user and/or patient identification. The user may then select a desired article by a variety of methods, such as by scrolling through a list of articles held within cabinet 12 which are displayed on viewscreen 16 or by typing in a name of the desired item. Once a desired article is selected, the drawer visual indicator 20 containing the desired article illuminates or otherwise indicates which drawer 18 contains the desired article. At this point, the appropriate drawer 18 is slid open. If drawer 18 contains a number of trays 24, tray sensor 22 also illuminates or otherwise indicates which tray 24 contains the desired article.

Once the proper tray 24 has been located, the controller permits lid 28 to be slid back to reveal the desired compartment 26 while preventing access to all other compartments having articles. The controller permits lid 28 to be slid back to reveal the desired compartment 26 by keeping track of both the overall distance of travel and the direction of lid 28 movement with respect to compartments 26 as previously described. When the desired compartment 26 is exposed, locking mechanism 37 engages to lock lid 28 in place. In this manner, access to additional compartments 26 containing additional articles or pharmaceuticals is denied. The user then removes the desired article from compartment 26.

The user may then close lid 28 manually, with a tapered tip of arm 38 allowing lid 28 to be pulled forward over arms 38 to cover the empty compartments 26. Alternatively, the user can simply close drawer 18. As drawer 18 is closed, lid 28 will contact the back of cabinet 12, thereby holding lid 28 in place as drawer 18 is pushed closed. Once lid 28 is closed to cover compartments 26, the user will preferably be required to input user and/or patient identification information before preselecting a second article. An alarm or other warning may sound if drawer 18 is not closed within a specified period of time. The controller then updates the inventory of cabinet 12 based on the user inputs.

Referring now to 7A–7G, operation of the latching mechanism of the present invention will be described in more detail. As the lid 28 is opened, the notches 30 and tabs 31 pass by the IR sensors 42 and 43 in an order which depends both on the position and direction of movement of the lid relative to the tray 24. The latching arms 38 and 39 will move in and out of engagement with the slots 32 in a manner which depends on the position of the lid 28 relative to the tray 24 as well as the rate at which the lid is being opened, i.e. the latches will not open if an attempt is made to open the lid 28 too rapidly relative to the tray 24. The manner in which the latching arms 38 and 39 sequentially engage the slots 32 is summarized in Table 1 below.

TABLE 1

Figure 7A:
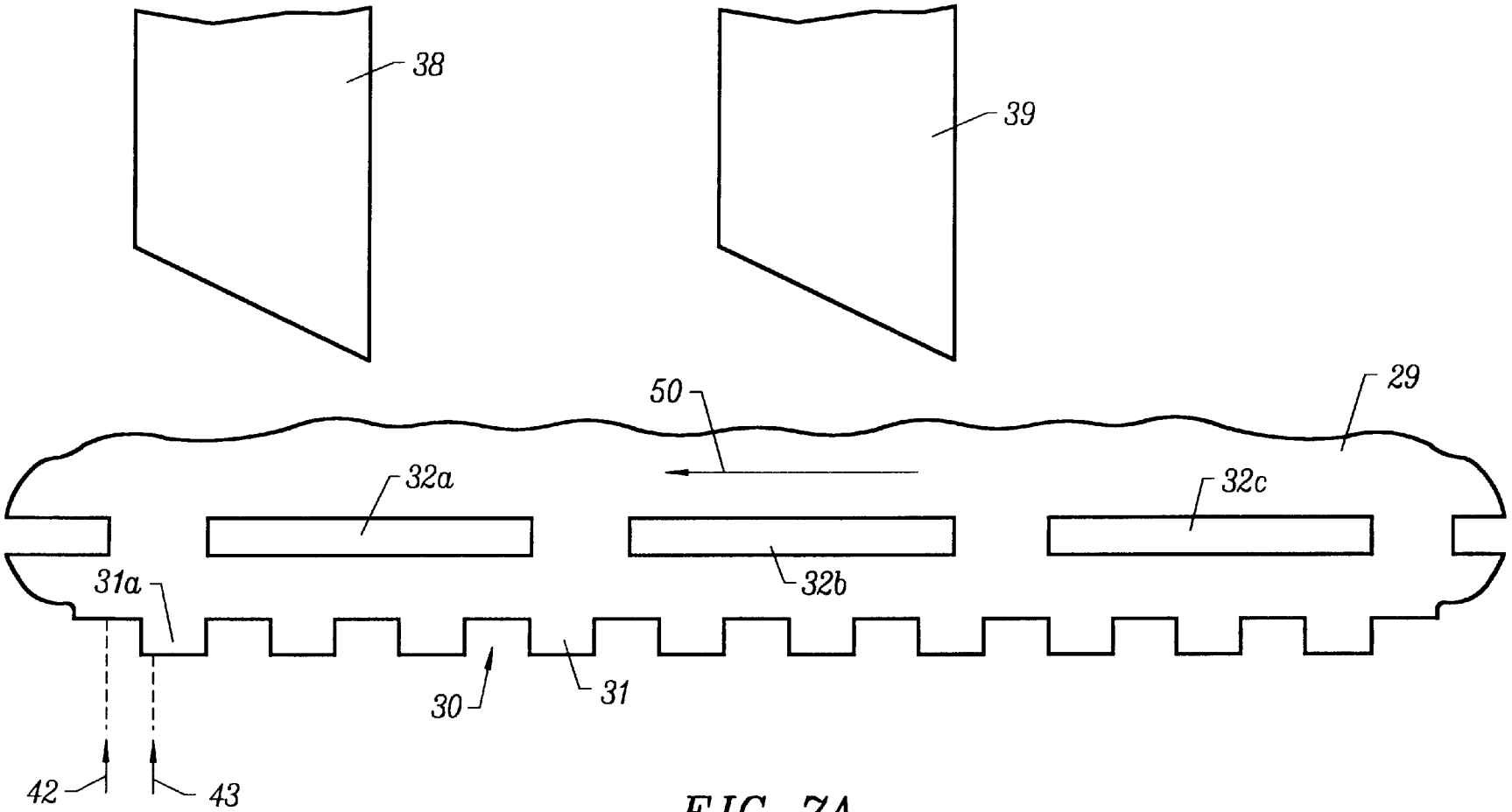
FIGS. 7A–7G illustrate the sequential locking pattern of the mechanism of FIG. 6.
Figure 7B:
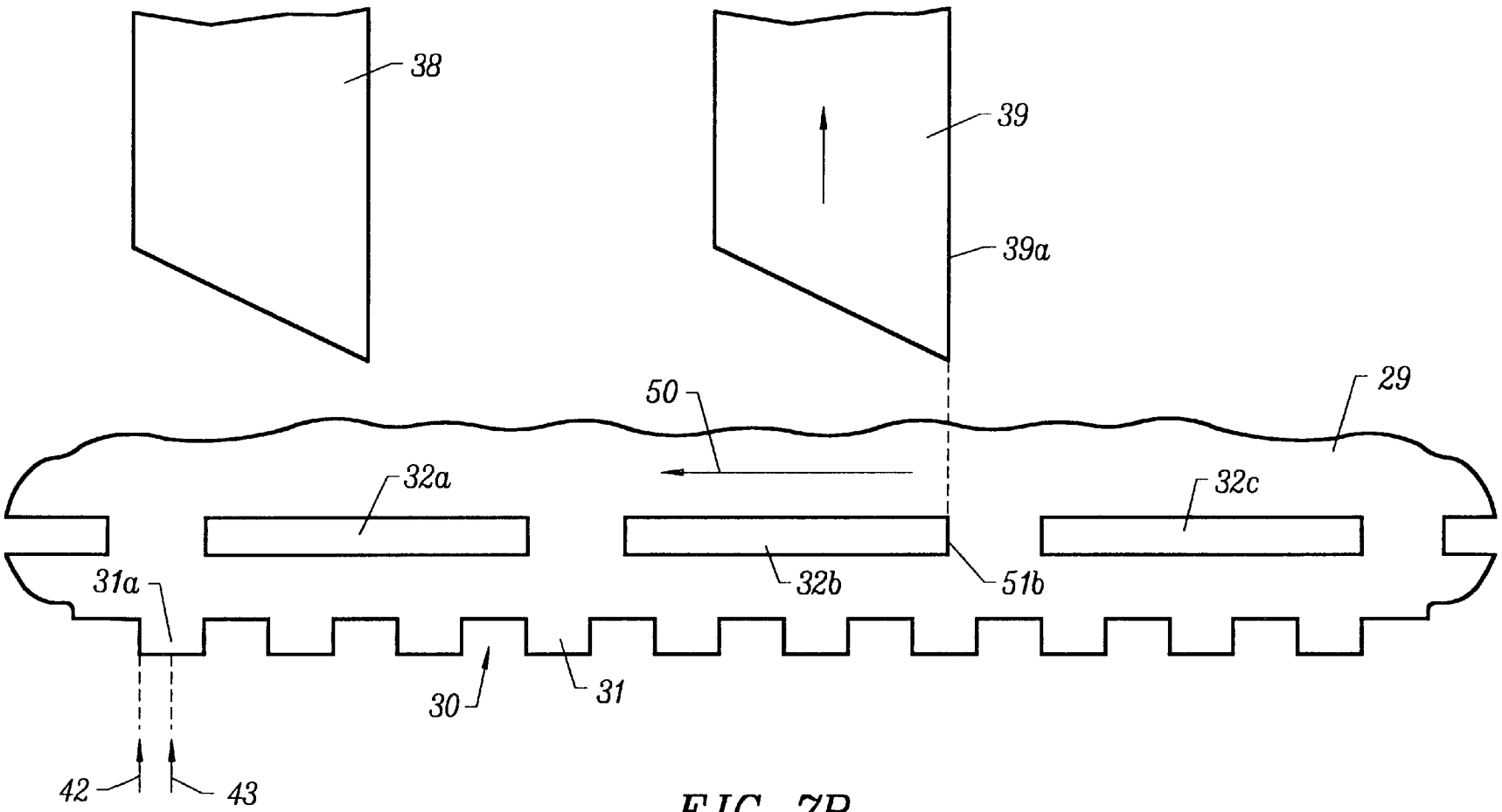
Figure 7C:
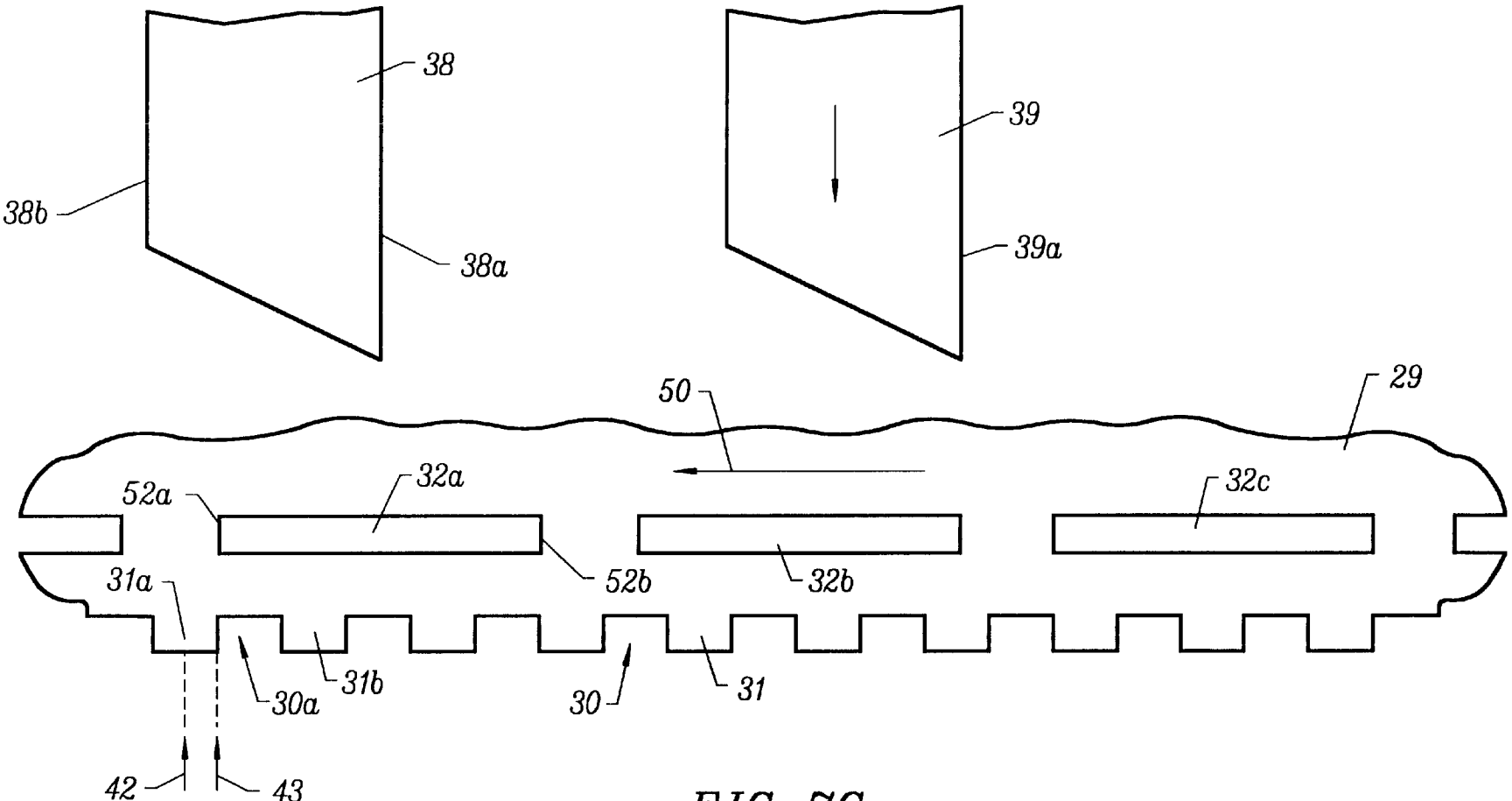
Figure 7D:
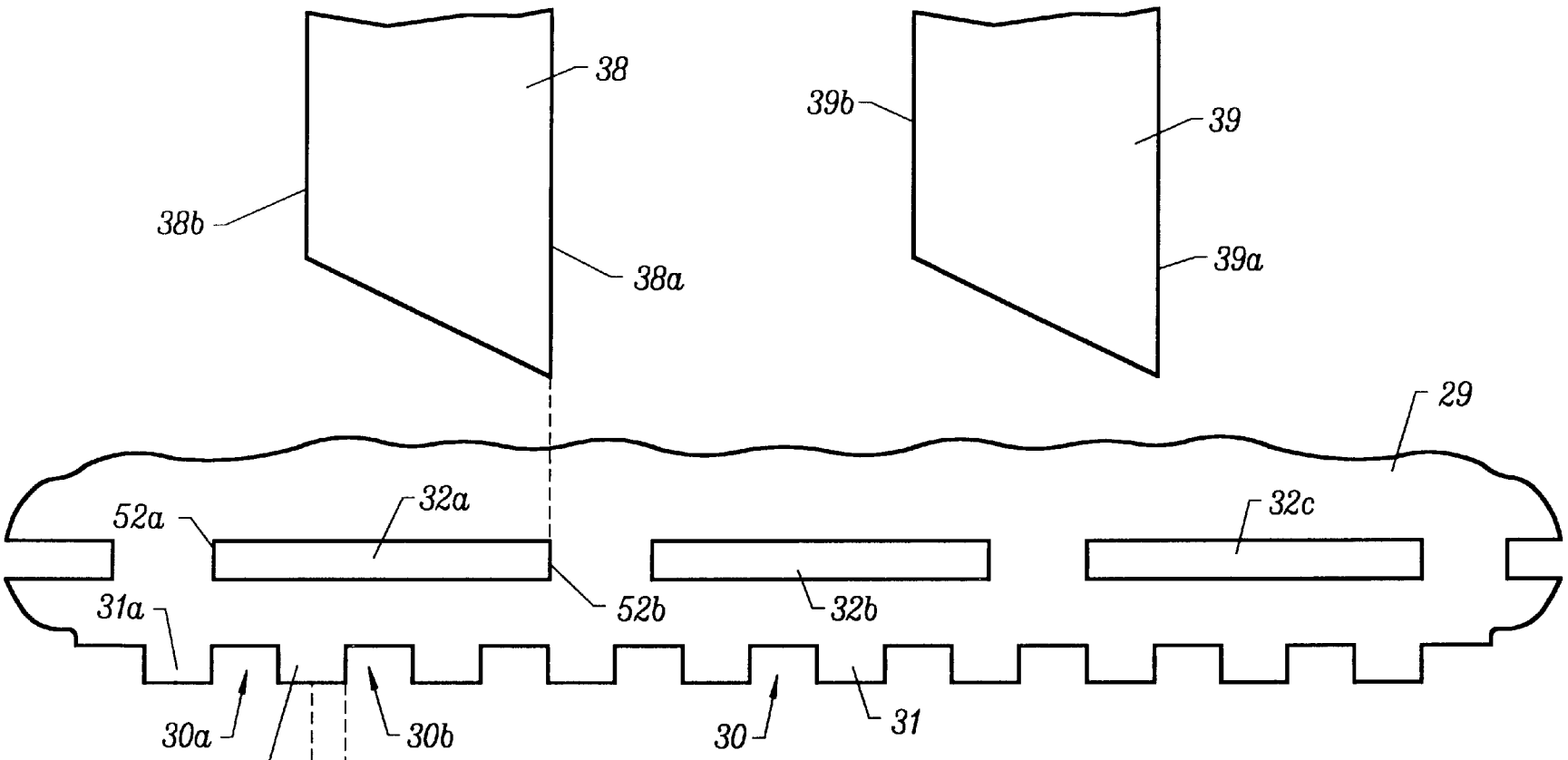
Figure 7E:
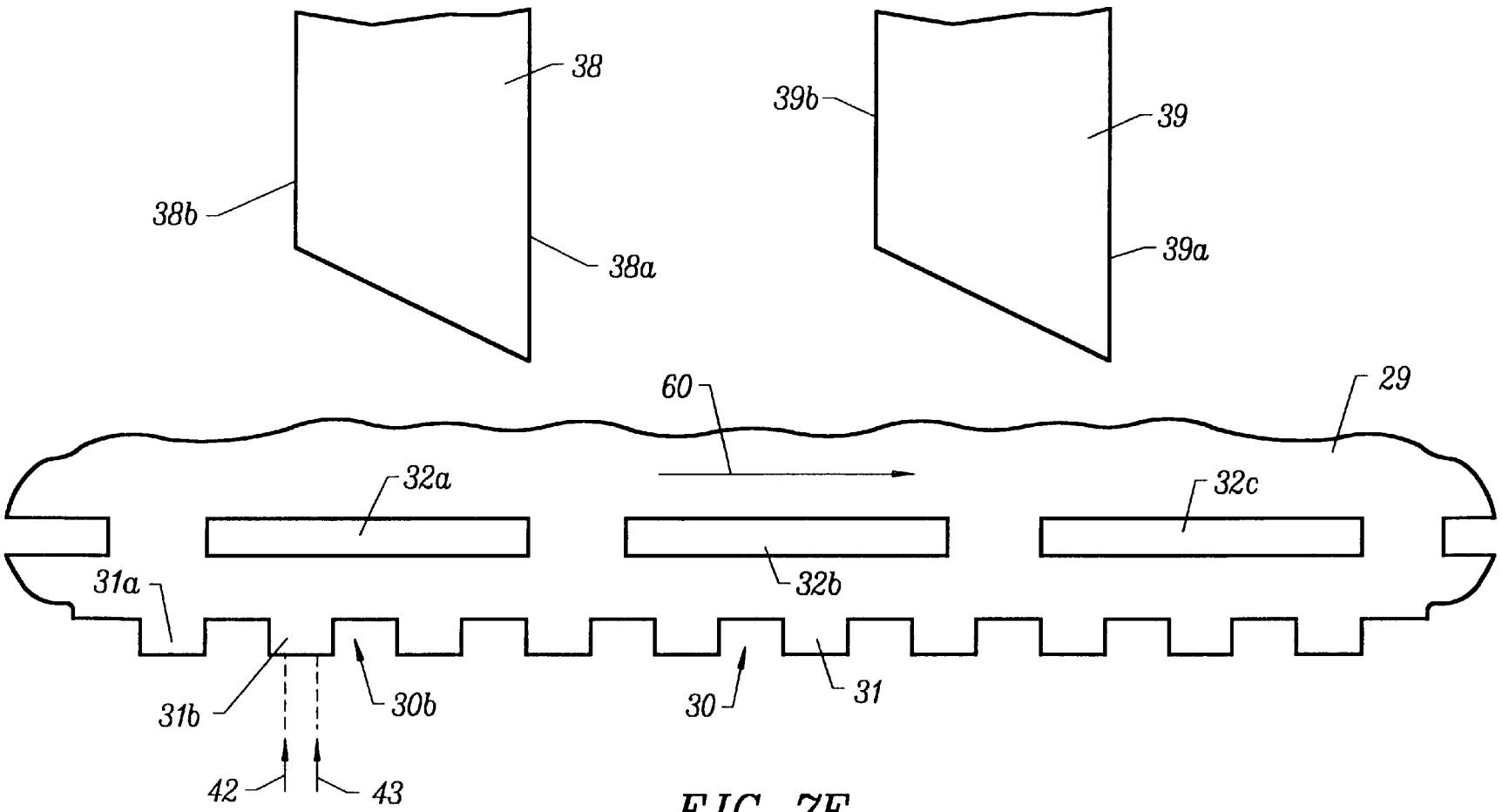
Figure 7F:
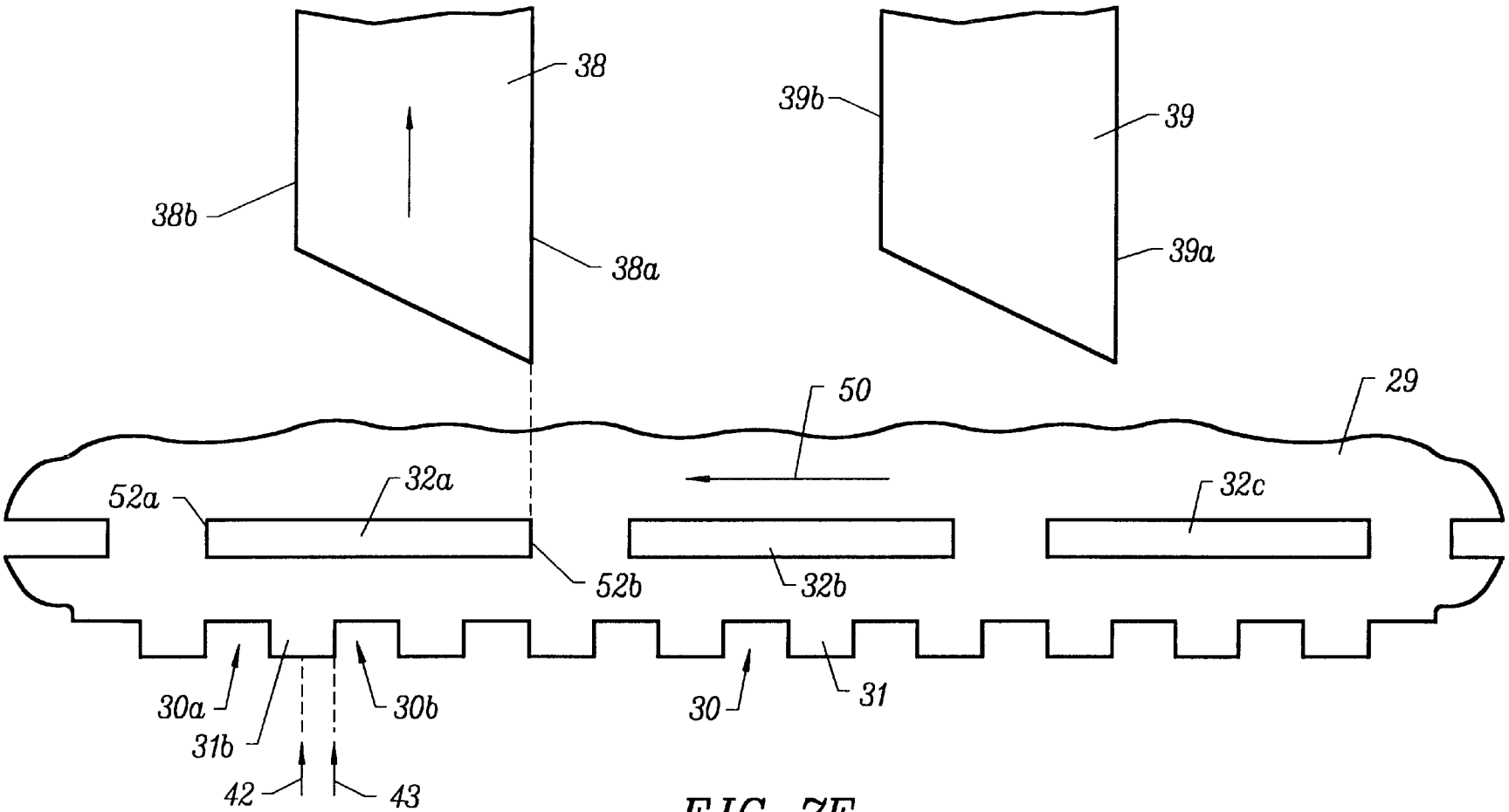
Figure 7G:
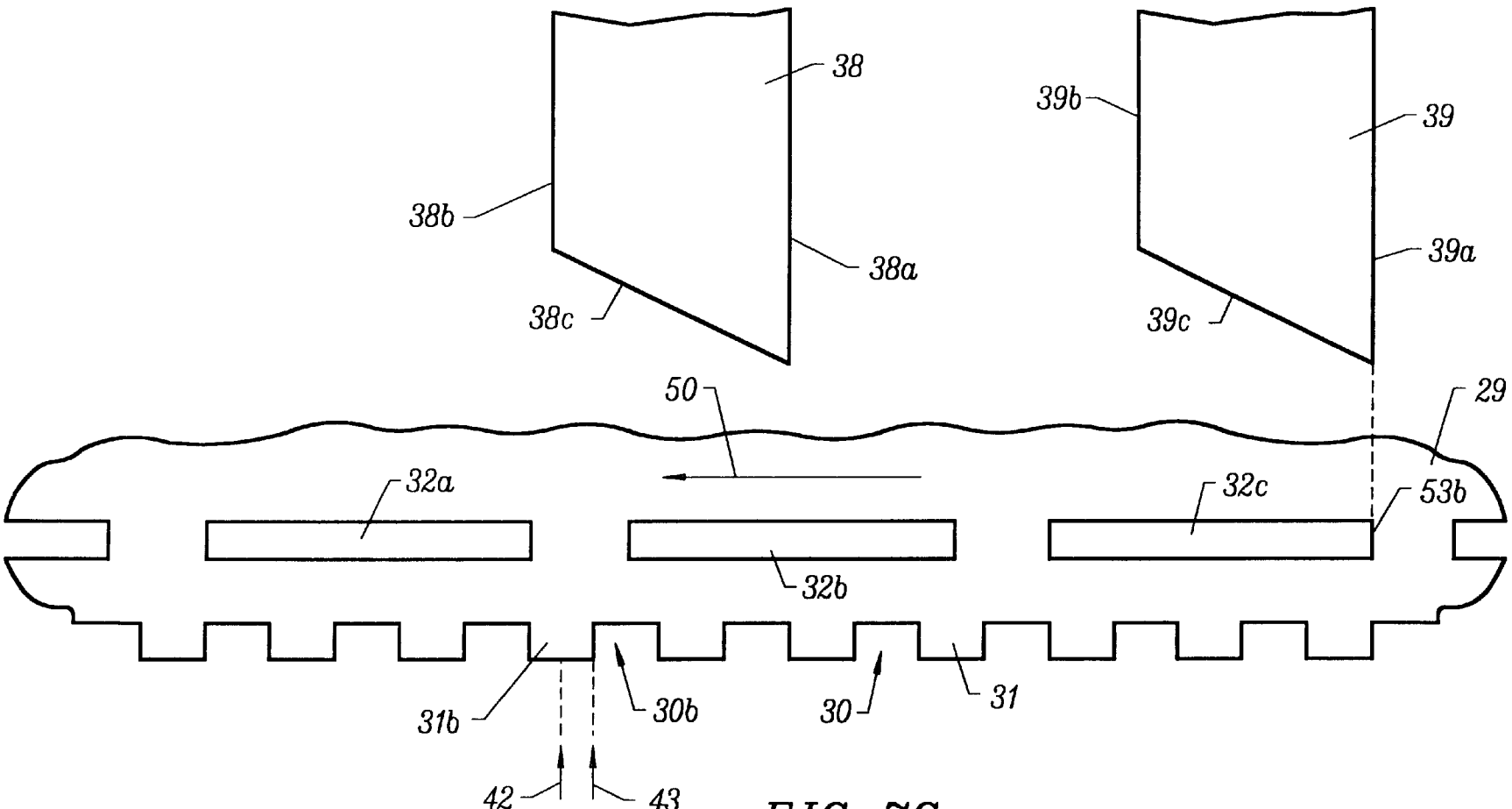

| POSITION | SENSOR 42 | SENSOR 43 | DIRECTION | LATCH 38 | LATCH 39 |
|---|---|---|---|---|---|
| FIG. 7A | O | X | Open | Engaged | Engaged |
| FIG. 7B | X↓ | X | Open | Engaged | Opens |
| FIG. 7C | O↓ | O | Open | Engaged | Closes |
| FIG. 7D | X | O↓ | Open | Engaged | Engaged |
| FIG. 7E | X | X | Close | Engaged | Disengaged |
| FIG. 7F | O↓ | O | Open | Opens | Engaged |
| FIG. 7G | X | X | Stop | Engaged | Locked |

FIG. 7A shows the relative positions of latching arms 38 and 39, slots 32, IR sensors 42 and 43, notches 30, and tabs 31, as the lid 28 is being opened over the tray 24. For simplicity, only the skirt portion 29 of the lid is illustrated and the tray is not illustrated in FIG. 7A–7G. It will be appreciated, of course, that the latching arms 38 and 39 as well as the IR sensors 42 and 43 are fixedly mounted relative to the tray so that the lid 24 can be locked against further opening by locking either one of the latching arms 38 or 39. Note that the latching arms 38 and 39 are spring-biased when they are engaged in slots 32. Thus, the arms 38 and 39 may be unable to fully enter a slot 32 when first "engaged" but will slide into the slot after proper alignment is reached.

As shown in FIG. 7A, the lid 28 is being opened relative to the tray 24 in the direction of arrow 50. Latch 39 is engaged in slot 32*b*, and latching arm 38 is also engaged (but only partially seated in the slot). IR sensor 42 is aligned with a notch (indicated as being open "O" in Table 1) and IR sensor 43 is aligned with a tab 31 (indicated as being closed "X" in Table 1).

Referring now to FIG. 7B, as the lid 28 is further opened in the direction of arrow 50, the translation is detected by IR sensors 42 and 43. In particular, sensor 42 detects the leading edge of tab 31*a* (shown as state "X↓" in Table 1). The transition of sensors 42 and 43 from states O and X, respectively, to states X↓ and X, respectively, signals the control system that a trailing edge 51*b* of slot 32*b* has reached alignment with the trailing edge 39*a* of latching arm 39. At this point, the controller will make a decision based on whether the lid 28 is to be further opened (i.e. whether additional tray compartment(s) 26 are to be exposed). If additional tray compartment(s) 26 are to be exposed, the latching arm 39 will be opened to disengage the arm from the slot 32*b*. Latching arm 38 will remain engaged and will fully enter slot 32*a* as the lid 28 is further opened in the direction of arrow 50. For the purposes of the present description, it will be assumed it is desired that the lid 28 be opened further.

Referring now to FIG. 7C, further opening of the lid 28 in the direction of arrow 50 is detected by IR sensors 42 (which remains in state X) and 43 (which changes to state O) and latching arm 38 fully engages slot 32*a* preventing further lid translation in the direction of arrow 50 once trailing edge 38*a* comes into contact with 52*b* (FIG. 7D). IR pair 43 detects the trailing edge "O↓" of 31*a* causing latch 39 to close. Latch 39 closes against the metal between slots 32*b* and 32*c*. With the lid 28 moving in the direction 50, the tip of latch 39 slides against the metal until the tip eventually enters slot 32*c*, at which point the spring-biased arm enters the slot. One latch is always engaged as the lid is pushed open in direction 50. IR sensor 43 remains in the O state.

The tray 28 may be further opened in the direction of arrow 50 until the trailing edge 38*a* of latching arm 38 engages the trailing end 52*b* of slot 32*a*, as illustrated in FIG. 7D. At that point, the controller must decide whether or not to disengage latching arm 38 to permit further opening of the lid 28 over the tray 24. In particular, the controller will recognize this position when IR sensor 43 first detects notch 30*b* and changes to state O↓. IR sensor 42 will remain in the X state. If no further access to the tray compartment(s) 26 is to be provided, the latching arm 38 will remain engaged within slot 32*a* (FIG. 7E). If further access is to be provided, latching arm 38 will be opened, and the lid 28 further retracted as described below in connection with FIGS. 7F and 7G.

Should the latching arm 38 remain engaged and the lid 26 thus be locked, the user will eventually close the lid 28 in the direction of arrow 60 in FIG. 7E. The controller will sense the reverse direction of translation through the change in state of IR sensors 42 and 43. As shown in Table 1, sensor 42 will remain in state X, while sensor 43 will return to state X. Further retraction of lid 28 in the direction of arrow 50, in contrast, would have caused IR sensor 42 to enter state O while IR sensor 43 remained in state O. It should be understood that the ability to sense changes in direction of relative motion is inherent within the quadrature system utilized in the present invention. Moreover, the quadrature system employing IR sensors 42 and 43 will track the position of lid 28 over tray 26 by incrementing and decrementing the passage of notches 30 and tabs 31, depending on the direction in which the lid is being moved relative to the tray.

Assuming now that the controller elects to open latching arm 38 after the trailing edge 38*a* reaches the trailing end 52*b* of slot 32*a* (as illustrated in FIG. 7D), the arm 38 then opens momentarily (FIG. 7F) so that lid 28 may advance in the direction of arrow 50. As soon as lid 28 advances far enough so that IR sensor 42 changes state, the controller will close arm 38. Because latching arm 39 remains engaged into the slot 32*c,* the lid 28 may continue to be opened relative to the tray 24 until the trailing edge 39*a* of latching arm 39 encounters the trailing end 53*b* of slot 32*c,* as shown in FIG. 7G. At this point, it will be assumed that further opening of the lid 28 is undesired. Latching arm 39 will remain locked in the engaged configuration as shown in FIG. 7G, and no further translation of the lid in the direction of arrow 50 will be permitted.

After removing the desired items from the last exposed tray compartment 26 (not shown), the user will then close the lid 28, either directly by pulling the lid closed or indirectly by closing the drawer 18. In either case, neither latching arm 38 nor 39 will prevent closing the lid. The controller may either disengage latching arms 38 and 39 (successively to prevent reopening the lid), or the spring-loaded latching arms may be configured so that the inclined edges 38*c* and 39*c,* respectively, will open whenever they encounter a leading edge of the slot 32. The controller will, as always, keep track of the position of lid 28 relative to the tray 24 in the manner described previously. When the tray is fully closed, either or both of the latching arms 38 and 39 may be engaged with appropriately positioned slots(s) in the lid skirt 29.

Although the foregoing invention has been described in detail for purposes of clarity of understanding, it will be appreciated that certain modifications may be practiced within the scope of the appended claims.

What is claimed is:

1. An apparatus for dispensing articles, the apparatus comprising:

a cabinet defining an enclosure;

at least one drawer movably attached to the cabinet, the drawer including an array of compartments;

at least one lid slidably attached to the drawer to prevent access to the compartments when positioned over the compartments, wherein the lid may be slid relative to the drawer to sequentially expose the compartments;

a locking mechanism which is engageable with the lid to selectively prevent movement of the lid relative to the compartments;

a distance sensor for detecting the distance traveled by the lid relative to the drawer; and a controller in communication with the locking mechanism and the distance sensor, wherein the controller may send a signal to actuate the locking mechanism after the lid has been moved to expose a first one of the compartments having a desired article, and wherein access to the next sequential compartments in the array is prevented by the lid.

2. An apparatus as in claim 1, wherein the lid includes spaced apart distance indicators, and wherein the distance sensor comprises a counter for counting the distance indicators and a direction sensor for detecting the direction of movement of the lid relative to the drawer.

3. An apparatus as in claim 1, wherein the distance indicators comprises an arranged pattern of notches.

4. An apparatus as in claim 3, wherein the counter comprises a first IR pair through which the notches of the lid are passed.

5. An apparatus as in claim 4, wherein the lid comprises a first side, a second side and a top, wherein the notches are included on the first and the second sides, with the notches on one of the sides alternating with the notches on the other side, wherein the notches of the first side are arranged to pass through the first IR pair, and wherein the direction counter comprises a second IR pair which is aligned with the first IR pair and through which the notches of the second side are passed.

6. An apparatus as in claim 5, wherein the lid includes a plurality of slots, and wherein the locking mechanism comprises at least one solenoid having an arm for engaging the slots of the lid.

7. An apparatus as in claim 1, wherein the array of compartments is formed within a tray which is removable from drawer.

8. An apparatus as in claim 7, wherein the drawer includes multiple trays, each of which includes an array of compartments, and wherein the trays include interlocks for connecting the trays within the drawer.

9. An apparatus as in claim 1, wherein the controller includes an entry device for entering article removal information, wherein the lid is locked by the locking mechanism until removal information is entered into the controller.

10. An apparatus as in claim 9, further comprising multiple columns of compartments, wherein a visual indicator is included on the drawer adjacent to each of the columns, wherein the visual indicators are in communication with the controller so that the visual indicator which is adjacent the column having a requested article may be actuated.

11. An apparatus as in claim 1, further comprising a drawer lock to lock the drawer to the cabinet.

12. An apparatus as in claim 6, wherein the first and the second sides of the lid include offset slots, and wherein the locking mechanism comprises a pair of solenoids, wherein one solenoid is associated with each of the lid sides.

13. A method for dispensing articles, the method comprising:

providing a cabinet having at least one drawer, with the drawer having an array of compartments for holding the articles;

providing at least one lid which is slidably attached to the drawer to prevent access to the compartments when positioned over the compartments, wherein the lid may be slid relative to the drawer to sequentially expose the compartments;

withdrawing the drawer from the cabinet to expose the lid;

sliding the lid from the drawer to sequentially expose the array of compartments until a first one of the compartments having an article is exposed, whereupon movement of the lid relative to the drawer in a direction which would expose any additional articles is prevented; and withdrawing the article from the compartment.

14. A method as in claim 13, wherein the cabinet includes a controller, and further comprising entering article removal information into the controller, wherein the lid is locked until the removal information is entered.

15. A method as in claim 14, further comprising entering the number of articles to be removed into the controller and sliding the lid from the drawer to expose the selected number of articles, whereupon movement of the lid relative to the drawer in a direction which would expose any additional articles is prevented.

16. A method as in claim 13, wherein movement of the lid relative to the drawer is prevented with a locking mechanism which is engageable with the lid.

17. A method as in claim 16, further comprising storing information regarding which compartments in the array have an article therein, and further comprising determining the distance travelled by the lid relative to the compartments and actuating the locking mechanism after the lid has been moved a distance sufficient to expose only the first one of the compartments having the article.

18. A method as in claim 17, wherein the lid includes a plurality of distance indicators, and wherein the step of determining the distance travelled by the lid further comprises counting the number of distance indicators on the lid and determining the direction of travel of the lid relative to the drawer.

19. A method as in claim 18, wherein the lid comprises a first side, a second side, and a top, wherein the first and second sides include alternating notches, wherein the cabinet includes a pair of aligned sensors, and wherein the step of determining the direction of travel comprises sensing the order of alternation of the notches on the first and the second sides with the sensors when the lid is moved.

20. A method as in claim 16, wherein the locking mechanism comprises a solenoid having an arm, wherein the lid includes a plurality of slots, and wherein the lid is locked to the drawer by engaging the arm with one of the slots.

21. A method as in claim 14, wherein the drawer is locked to the cabinet, and further comprising entering user identification information into the controller to unlock the drawer from the cabinet.

22. A method as in claim 13, wherein only a single article is held within each compartment.

23. A method as in claim 13, wherein the drawer includes multiple arrays of compartments which are arranged in columns, and further comprising producing a visual signal adjacent the column having the selected article.

* * * * *